United States Patent [19]

McNeill et al.

[11] 3,971,187

[45] July 27, 1976

[54] METHOD OF MAKING VACUUM WRAPPED SHIRRED SAUSAGE CASINGS

[75] Inventors: Frank M. McNeill, Lombard; Harold H. Martinek, Danville, both of Ill.

[73] Assignee: Continental Can Company, Inc., New York, N.Y.

[22] Filed: June 4, 1975

[21] Appl. No.: 583,730

Related U.S. Application Data

[63] Continuation of Ser. No. 438,305, Jan. 31, 1974, abandoned.

[52] U.S. Cl. ..... 53/21 FC; 53/22 B; 206/802

[51] Int. Cl.[2] ..... B65B 31/02

[58] Field of Search ..... 53/22 A, 22 B, 112 A, 53/112 B, 21 FC; 206/802

[56] References Cited

UNITED STATES PATENTS

| | | | |
|---|---|---|---|
| 2,814,382 | 11/1957 | Lassiter | 53/22 B X |
| 3,164,934 | 1/1965 | Pancratz | 53/112 A |
| 3,267,634 | 8/1966 | Omori | 53/112 A X |
| 3,528,825 | 9/1970 | Doughty | 53/30 X |
| 3,764,351 | 10/1973 | Whittington et al. | 206/802 X |

*Primary Examiner*—Travis S. McGehee
*Attorney, Agent, or Firm*—Paul Shapiro; Joseph E. Kerwin; William A. Dittmann

[57] ABSTRACT

One or more shirred artificial sausage casings are tightly packaged in a flexible film to reduce lateral and longitudinal expansion and to protect against moisture loss. The flexible film is caused to fit tightly about the artificial sausage casings by enveloping the casings within at least one flexible film, removing sufficient air from within the resulting envelope for producing a partial vacuum therein and sealing said envelope for maintaining said partial vacuum.

9 Claims, 8 Drawing Figures

METHOD OF MAKING VACUUM WRAPPED SHIRRED SAUSAGE CASINGS

This is a continuation of application Ser. No. 438,305, filed Jan. 31, 1974, now abandoned.

DESCRIPTION OF THE PRIOR ART

Artificial sausage casings generally are prepared as hollow, thin-walled tubes of very great length. For convenience in handling, these casings are shirred from lengths ranging from about 40 – 160 feet or more to a shirred and compressed length of the order of a few inches.

In the preparation and use of artificial sausage casings, particularly those casings formed from regenerated cellulose, the regulation of moisture content in the casing is of extreme importance. When the regenerated cellulose casings are first formed, they are dried to a relatively low water content, e.g., from about 8 – 10%. If the water content varies outside this range, damage often results to the casing during the shirring operation either as the result of brittleness in the casing or because of a sticking of the casing to the shirring mandrel.

After the casing is shirred or during shirring, the moisture content of the casing is raised to about 14 – 20% for shipment to meat packing houses. At the packing houses, the individual shirred strands are placed on a stuffing horn and meat emulsion is extruded to fill the casing to its fully extended length. In high speed stuffing apparatus, this takes place within a few seconds so that the casing is extended from a shirred length of from about 8 – 27 inches to an extended length of about 40 – 160 feet in length. In general, an average moisture content of from about 14 – 20% in the regenerated cellulose shirred casing is required for satisfactory stuffing. If the moisture content of the casing is substantially below about 14%, e.g., 10%, then the casing may be brittle and result in excessive breakage. On the other hand, if the moisture content exceeds about 20%, the casing usually is over plasticized and may overstuff.

In the usual course of events, shirred artificial sausage casings are packaged in cardboard or plastic containers. Several objectives of the package are desired. One is that when the sausage casing is properly humidified, i.e., humidified so that the moisture content of the casing is from about 14 – 20%, the package permits retention of this water in the casing during storage. Secondly, the package should restrict longitudinal movement or creeping of the shirred artificial casing.

A common package for artificial sausage casings is a cardboard box employing end panels having a plurality of apertures therein for permitting humidification of the casing while in the cardboard package. These cardboard boxes are commonly referred to in the art as "caddies". The caddies serve a two-fold purpose in that they permit humidification of the casing after it is shirred and they restrain longitudinal movement of the shirred casing during storage.

Various adaptations have been made with the caddy and one includes the use of absorbent paper liners for separating the shirred artificial sausage casings in layers. These liners typically are moistened with water in order to equilibrate the casings with moisture during storage. The caddies then are wrapped with a moisture impervious material and sealed to insure that the moisture is not lost during storage.

A more recent package for artificial sausage casings includes a heat shrinkable film. In packaging, the shirred casing is placed within a shrinkable tubular film and then the film is caused to shrink about the shirred casing. The ends are secured by clamps to restrict the longitudinal expansion of the casing.

Several disadvantages were noted with the "caddy" packaging techniques for artificial sausage casings. The cardboard boxes for caddies were expensive. Second, the casings often were not properly or uniformly humidified. Air circulation, particularly with shirred casings having end closures, often tended to be poor. The liners used to aid in humidification tended to create a handling and disposal problem for the meat packer and the casings, often because of longitudinal expansion, became wedged in the caddy and were difficult to remove without damage.

Disadvantages also were noted in the packaging of shirred artificial sausage casings with a shrinkable tubing. One of the problems centered about the fact that the shrinkable tubing had a tendency to pull the casings together in a rounded manner and effected a flattening of the ends of the casing. Also, the tension was nonuniform and when applied to the casing effected a bowing of the shirred casing sticks when the sticks were not in proper alignment. Further, moisture, when added to the package, tended to flow into the bore of the casing and this sometimes interfered with the coatings applied to the interior of the casing.

SUMMARY OF THE INVENTION

In accordance with this invention, there is shown a method for packaging an artificial sausage casing or plurality thereof for reducing lateral and longitudinal expansion and to protect against moisture loss and the resulting product. The method comprises enveloping a casing or plurality thereof within at least one flexible film which is substantially impermeable to gas, e.g. air and water vapor, removing sufficient air from within the resulting envelope for producing a partial vacuum therein, and sealing said envelope for maintaining said partial vacuum. The evacuation of the envelope causes the flexible film to nestle about the casing or plurality thereof, to provide substantially equal forces perpendicular to the longitudinal axis of the casing or plurality thereof, and to effect a seal along the ends of the casing to prevent a substantial proportion of moisture from passing into the bore of the casing.

Advantages of the instant package include: a package which fits snugly about the casing along its longitudinal surface and against the ends to restrict longitudinal expansion; a package which prevents moisture loss from the casing during storage; a package which conforms to the casing surfaces from end to end even where there may be a size differential; a package which exerts substantially uniform pressures on the casing even where environmental disturbances cause slight contraction or expansion of the casings; a package which reduces flattening of the casings; a package which reduces bowing of the casing sticks; a package which nestles about the edges and ends of the casings to effect a seal and prevent substantial moisture leakage into the interior of the casings; and a package which permits easy removal of casings from shipping containers and prevents such casings from becoming wedged in such containers.

THE DRAWINGS

DESCRIPTION OF THE PREFERRED EMBODIMENTS

Figure 2:
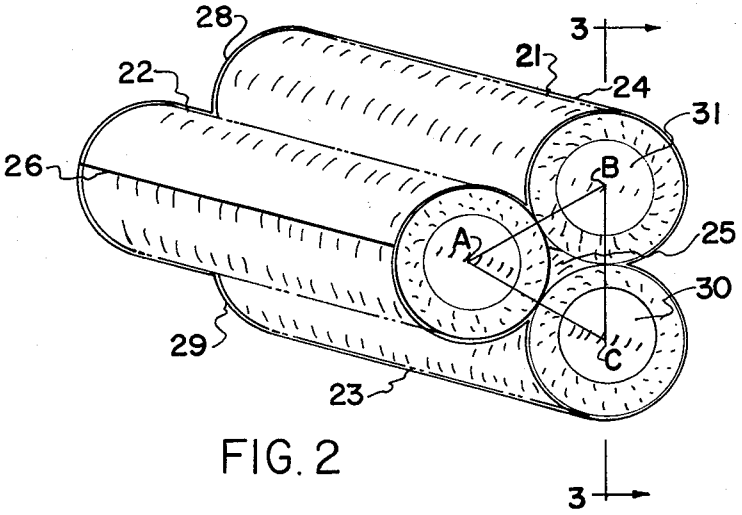
FIG. 2 is an oblique view of a plurality of shirred artificial sausage casings packaged within a flexible film which is substantially impermeable to air.

The artificial sausage casings which can be packaged in a flexible film in the manner contemplated by this invention are those of regenerated cellulose, polyvinyl alcohol, collagen, alginates, amylose, and microporous thermoplastic films. In a preferred embodiment, however, the artificial sausage casing is of the regenerated cellulose type including both the fibrous or non-fibrous casing. The non-fibrous casings lend themselves more to this type of packaging than the fibrous casings because the latter generally have to be soaked in water prior to stuffing whereas the non-fibrous are only slightly humidified. The non-fibrous casings typically have a shirred diameter ranging from about ½ to 1½ inches with a wall thickness ranging from about 0.0005 to about 0.005 inches. These non-fibrous casings prior to packaging are humidified by conventional means such as by spraying with a moisture providing liquid at the time of shirring, e.g., through spray nozzles at the shirring mandrel or by humidification in an appropriately conditioned room. The casings may also be humidified during packaging as subsequently described.

The flexible film for packaging the shirred casings is substantially impervious to gas for permitting removal of gas, e.g., air, within the envelope formed by the enveloping of the casings within a flexible film. By substantially impervious to gas, i.e. air or water vapor, it is meant that the film has a vapor transmission rate of less than about 1 cc/100 in.$^2$/24 hour/atm. It is understandable that if the flexible film were not impervious to air it would be practically impossible to remove the gas from the envelope carrying the artificial sausage casings, maintain a partial vacuum therein, and to prevent against moisture loss.

Films which are flexible and can be used for packaging shirred artificial sausage casing include the polyolefins such as polypropylene, polyethylene, polyvinyl chloride, polyvinylidene chloride, polyvinyl acetate, polyamides, copolymers of the above and coated films and laminates. Virtually any of the films acceptable for packaging of food which have the above qualities, e.g., impervious to water and air, can be used for packaging the shirred artificial sausage casings. Some, and particularly the laminates, have the added benefit that they are impervious to vapor and heat sealable. A nylon-polyvinylidene chloride (saran) or polyethylene-saran laminate has these properties and thus is advantageous for packaging shirred casings.

In packaging an artificial sausage casing or plurality thereof, the casings are enveloped in at least one flexible film. In one aspect the envelope can be formed by first forming a tube with one end and the sides sealed and then placing the artificial sausage casings in the resulting tubular film. The open end of the tubular film then can be attached to a vacuum source and the tubular film evacuated and sealed while maintaining a partial vacuum inside the tubular film. In another aspect, a plurality of casings can be disposed between two films, e.g. one film ply on the top and one film ply on the bottom. The casings including the film plies are placed in a vacuum chamber and a vacuum placed in the chamber. When a desired degree of evacuation in the chamber has been attained, the film plies are sealed to each other along the ends and edges to form a completely sealed package. The vacuum chamber then is vented and as the pressure in the chamber returns to atmospheric pressure, the external air pressure causes the film to nestle about the casing surface and the ends. The resulting packages formed by these techniques are illustrated in the drawings to be described below.

Figure 1:
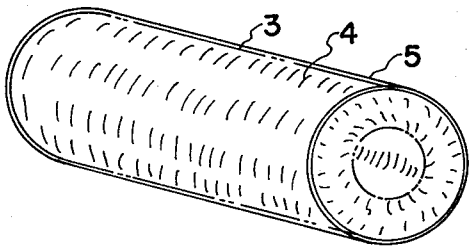
FIG. 1 is an oblique view of a shirred artificial sausage casing packaged within a flexible film.

In reference to the drawings, FIG. 1 is an oblique view of a shirred artificial sausage casing 3 having a plurality of shirring pleats 4 enclosed in a flexible film 5. In forming a packaged single shirred sausage casing, the casing 3 is placed inside of a flexible film formed into a tubular shape and the air space between the tubular shaped film and the casing evacuated sufficiently to pull the film about the shirred casing. The tubular film then is sealed at the end while under vacuum.

Figure 3:
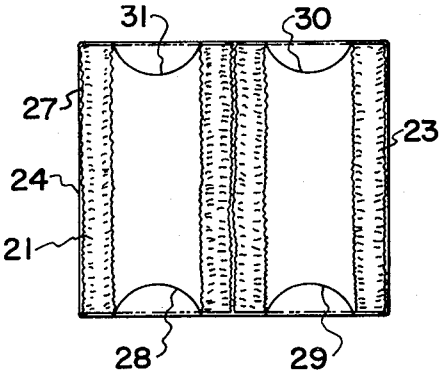
FIG. 3 is a cross sectional view of Line 3—3 of FIG. 2 showing the flexible film seating along the ends of the shirred casings and penetrating inwardly into the bore of the shirred casing for restricting longitudinal expansion.

FIG. 2 is an oblique view of a packaging arrangement for shirred artificial sausage casings which is particularly adapted for this invention. The shirred sausage casings 21, 22, and 23 are arranged in a nested manner in such a way that a portion of the external surface of one casing is in contact with the surface of casings disposed about it. In viewing an arrangement of the three artificial sausage casings within this packaging arrangement, one will form a triangle which is not a right triangle if the center lines A, B, and C of the respective casings are connected by straight lines. Where these casings are of the same size, as generally is the case where shirred casings are packaged, the triangle formed is an equilateral triangle. In packaging casings in this arrangement, the tubular sausage casings 21, 22, and 23 are arranged as shown and then placed in a flexible film 24 and sealed in this instance by heat sealing means to form a heat sealed seam 26. In viewing the packaging arrangement along the line 3—3 as shown in FIG. 3 one can observe the inward displacement of the flexible film 24 into the respective ends of casings 21 and 23, namely, 28, 29, 30, and 31. This inward displacement of the film caused by the evacuation of the air space between the flexible film and the sausage casings provides a seal about the edges of the casings to prevent substantial moisture from penetrating into the bore of the casing which may in effect wash off or leach a lubricant applied to the interior of the bore to enhance peelability of the casing.

Figure 4:
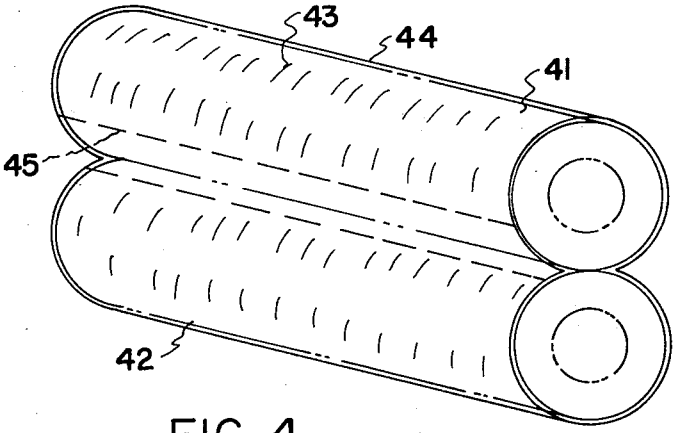
FIG. 4 is an oblique view of two artificial shirred sausage casings packaged within a flexible film provided with a tear strip for easy removal of the film from the casings.

FIG. 4 is an oblique view of another packaging arrangement for artificial sausage casings wherein casings 41 and 42 having a plurality of shirring pleats 43 are enclosed in a tubular film, e.g., polyethylene, with the air space evacuated and the film sealed. To enhance the ability of an operator to remove the enclosed film from the artificial sausage casings processed therein, a tear strip 45 is provided along the external surface of the tubular film. This tear strip can be employed in other types of packaging films as desired.

Figure 5:
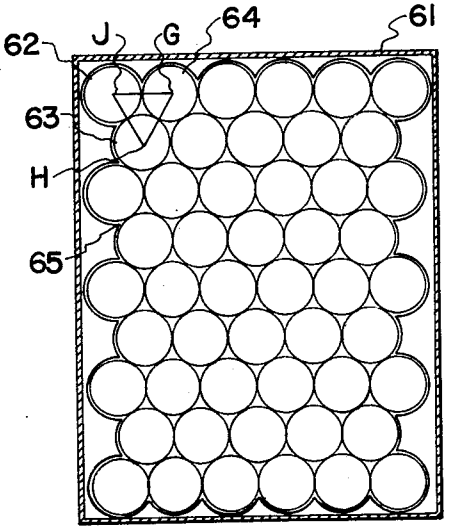
FIG. 5 is an end view of casings arranged in the flexible film.

FIG. 5 is an end view of a package of 50 sausage casings encompassed within a flexible film. The arrangement is similar to that nested arrangement shown in FIG. 2, i.e., casings 62, 63, and 64, which are arranged so that the center lines G, H & J when connected by straight lines form an equilateral triangle. In forming the package, the shirred sausage casings are enveloped in tubular shaped film 65 and held by cartridge 61. The air space between the tubular film 65 and sausage casings as represented by casings 62, 63, and 64 is evacuated to a desired level and the film sealed about the casings. Cartridge 61 usually is removed from the packaged casings and the package placed into a shipping container.

Figure 6:
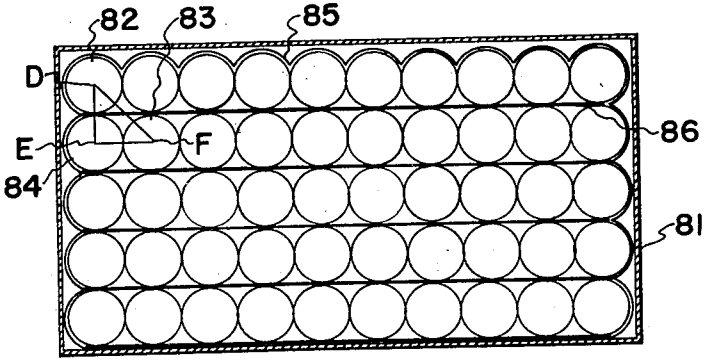
FIG. 6 is an end view of another arrangement of shirred artificial sausage casings vacuum packaged in a flexible film.

FIG. 6 is an end view of a packaging arrangement now employed in the marketing of artificial sausage casings. This arrangement is different than that shown in FIGS. 2 and 5 in that the casings as represented by 82, 83, and 84 are placed in side-by-side relationship in rows of ten and five deep in the package to make a total of 50 for the complete package. The casings are separated by porous liners 86 which are first moistened with water so that the liners can equilibrate with the artificial sausage casings in order to provide the desired proportion of moisture. In viewing an arrangement of three sausage casings, namely, 82, 83, and 84 which are disposed side by side, the centers D, E, and F when connected by straight lines form a right triangle as opposed to an equilateral triangle as shown in FIG. 5. In forming the package, the five rows of ten casings are enveloped in flexible film 85 and held in place by box 81. The air in the envelope is removed for producing a partial vacuum therein and the film sealed for maintaining the partial vacuum. The resulting casings then are removed from box 81 and placed in a shipping container for sale.

Figure 7:
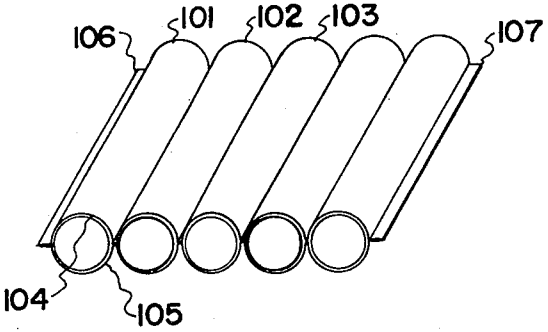
FIG. 7 is an oblique view of casings packaged as a strip in side by side relationship.

FIG. 7 is an oblique view of another arrangement which can be adapted for the packaging of artificial sausage casings. In the manufacture of this type package, it is convenient to envelop representative casings 101, 102, and 103 between flexible film plies 104 and 105. This assembly of casings and flexible plies is placed in a vacuum chamber. The chamber is evacuated to a desired pressure, e.g., 0.5 to 0.9 atmospheres, and while the chamber is at such pressure, causing the plies to be sealed together at ends 106 and 107 and along the edges (not numbered). After the casings are completely sealed between the two film plies 104 and 105, the vacuum chamber is vented to the atmosphere. The external air pressure causes the film to conform to the casing as shown and to restrict longitudinal movement of such casing while in the package.

Figure 8:
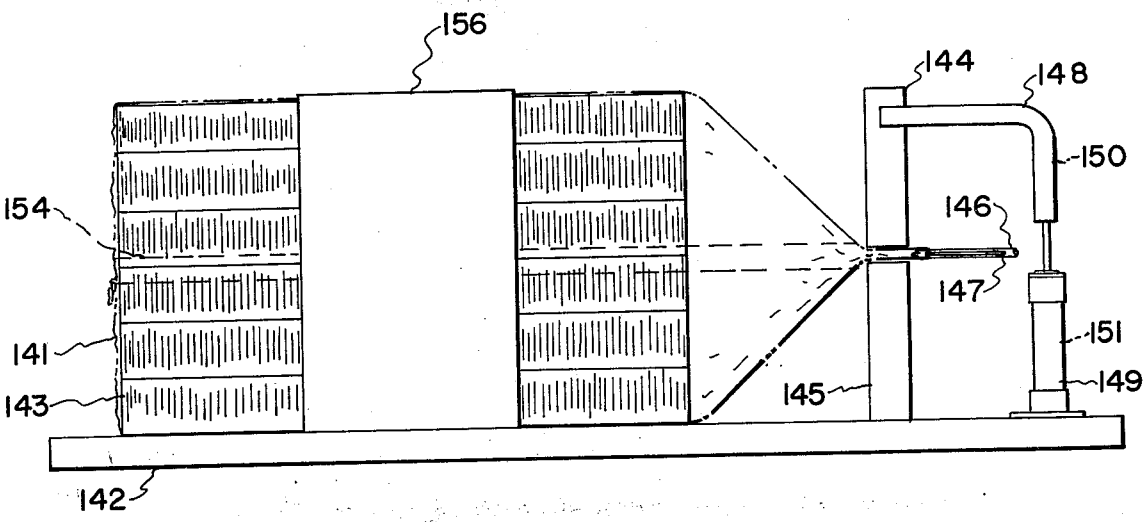
FIG. 8 is a frontal view of an apparatus for packaging casing within a flexible film showing a means for evacuating the space between the film and casings and means for sealing the film.

To illustrate a method for packaging a plurality of shirred artificial sausage casings (cellulose or collagen) within an air impermeable film, reference is made to FIG. 8. In FIG. 8 a flexible tubular shaped film 141 comprising a laminate of saran and nylon is sealed across the sides and one end and has a tear strip 154 along a side and is placed upon table 142. A plurality of shirred artificial sausage casings 143 are placed in tubular film 141 in a configuration as shown in FIG. 5 and held by cartridge 156. In this arrangement, the casings are arranged in five rows of six casings each separated by four rows of five casings each. This commonly is referred to as hexagonal close packed or nested arrangement. The open end of the tubular film 141 is placed between two heat sealing bars, 144 and 145. These bars are used to secure the tubular film 141 to itself by means of heat after the air space between the tubular film 141 and casings 143 is evacuated. The open end of the tubular film 141 is threaded through and between the heat sealing bars 144 and 145. Vacuum source 146 is inserted into the open end of the tubular film 141. The open end of the tubular film 141 then is secured to the vacuum source 146 to prevent air leakage and permit evacuation of the air space between the tubular film 141 and artificial sausage casings 143.

During evacuation, vacuum source 146 normally is withdrawn beyond heat sealable bars 145 and 146. On the other hand, there are commercial vacuum packaging apparatus which permit the vacuum source to extend beyond the heat sealing bars during evacuation. In that type of apparatus, however, the vacuum source is moved to a point in back of the heat sealing bars during the heat sealing operation so that the vacuum source is not trapped. One disadvantage with this type of apparatus often is that some of the vacuum in the air space between the tubular film and artificial sausage casings is lost as the vacuum source is moved to a point in back of the sealing bars.

In some operations and prior to the achievement of a desired level of evacuation of the air space between the tubular film and casings, a predetermined amount of moisture is introduced into the package. Often this is introduced by rod 147 being placed into the annulas (not shown) but is particularly shown in FIG. 2 as 25. The moisture content of the artificial sausage casings for regenerated cellulose generally should be between 14 and 20% and can be provided by the addition of a moisture providing liquid, e.g., water, glycerin, or mixture thereof. The technique of evacuating the air space between the tubular film 141 and artificial sausage casings 143 prior to introduction of moisture prevents substantial moisture from entering into the bore of the artificial sausage casings by flowing around the ends of the casings. On the other hand, because the external surface of the casings are not smooth primarily because of pleats 4 as shown in FIG. 1, the liquid will flow along the external surface of the casings into voids to effectuate an overall moistening or humidification of the casings. It should be noted that other additives (flavorants) to the casing can be added through rod 147 or the casing can be flushed with an inert gas before vacuum is applied.

After the proper proportion of moisture has been added to the casings, rod 147 is pulled back to a point behind the heat sealing bars 144 and 145. Continuous evacuation of the air space is maintained to provide an absolute pressure in the air space not substantially less than about 0.4 atm. In most instances, the absolute pressure in the air space between the tubular film and artificial sausage casings is caused to be between about 0.5 – 0.9 atm. and preferably between about 0.6 – 0.75 atm. As might be expected as the absolute pressure in the air space is reduced, i.e., substantially below about 0.4 atm., the pressures placed upon the surface of the artificial sausage casing, while in their arranged condition, can cause flattening of the casings. This flattening of the casing particularly at the ends may make them unacceptable for high speed automatic stuffing machines. If the absolute pressure in the air space is above about 0.9 atm. then usually there is not sufficient restraint to prevent longitudinal expansion of the casing or sealing of the film about the ends. Experience has shown that absolute pressures of about 0.6 – 0.75 atm. provides adequate sealing to effect protection of the artificial sausage casings packaged in the tubular film and prevent longitudinal expansion and yet does not effect a flattening of the casing wall or end.

After the air space has been evacuated to the desired absolute pressure, sealing bar 144 which is supported by members 148 and 150 is caused to move downwardly by pneumatic cylinders 149 and 151 thereby bringing the sealing bar substantially in contact with the sealing bar 145 which is supported by Table 142. (Support member 150 and pneumatic cylinder 151 are hidden by member 148 and cylinder 149, respectively, and, therefore, shown by dotted line.) Once these sealing bars are pressed together, heat is applied to effect heat sealing of the laminate. After the open end of the tubular film is secured by heat sealing, sealing bar 144 is moved upwardly by appropriate movement of cylinders 149 and 151 and the package is removed.

The resultant package maintains the pre-arranged alignment of the artificial sausage casings and provides a desirable package for maintaining proper moisture in the casings during an extended period of storage. Further, the substantially equal forces which are applied uniformly along the casing wall tend to reduce longitudinal expansion of the casing during storage and reduce the tendency of bowing.

We claim:

1. A method for packaging a shirred artificial sausage casing which comprises enveloping said casing within a flexible tubular film, said film having a transmission rate for air of less than about 1cc/100in$^2$/24 hr.-atm removing sufficient air from within the resulting envelope to produce therein an absolute pressure of substantially not less than about 0.4 atmospheres, and then sealing said envelope for maintaining said pressure.

2. The method of claim 1 wherein a plurality of casings are packaged within said flexible film.

3. The method of claim 1 wherein the absolute pressure in said envelope is from about 0.5 – 0.9 atmosphere.

4. The method of claim 3 wherein said flexible film has a transmission rate for air of less than about 1 cc/100in.$^2$/24 hour-atm. and a water vapor transmission rate of less than about 1 cc/100 in. $^2$/24 hour-atm.

5. The method of claim 4 wherein said flexible film is heat-sealable.

6. The method of claim 5 wherein said shirred casings are of regenerated cellulose.

7. The method of claim 6 wherein said plurality of casings are of substantially the same diameter and are arranged in a nested configuration.

8. The method of claim 7 which includes the step of adding a predetermined amount of moisture to said package while said envelope has a partial vacuum therein and prior to sealing the flexible film.

9. The method of claim 6 wherein said shirred casings are enveloped between at least two film plies for forming an assembly of film plies and casings, placing the assembly in a vacuum chamber and evacuating said chamber to said pressure of 0.5 – 0.9 atmospheres, and then sealing said film plies against each other while said vacuum chamber is at reduced pressure.

* * * * *